US005510578A

United States Patent [19]

Dunlavy

[11] Patent Number: 5,510,578

[45] Date of Patent: Apr. 23, 1996

[54] AUDIO LOUDSPEAKER CABLE ASSEMBLY

[76] Inventor: John H. Dunlavy, P.O. Box 49369, Colorado Springs, Colo. 80949

[21] Appl. No.: 497,278

[22] Filed: Jun. 30, 1995

Related U.S. Application Data

[63] Continuation of Ser. No. 57,660, May 4, 1993, abandoned.

[51] Int. Cl.[6] ..... H01B 5/08

[52] U.S. Cl. ..... 174/128.1; 174/103; 381/94

[58] Field of Search ..... 174/126.1, 126.4, 174/128.1, 128.2, 130, 102 R, 102 C, 103, 105 R, 110 R, 113 R, 36, 109, 107; 333/243, 244; 381/93, 94, 96, 120, 121

[56] References Cited

U.S. PATENT DOCUMENTS 4,208,542 6/1980 Endo ..... 174/113 C
4,954,095 9/1990 Cogan ..... 439/284
5,216,202 6/1993 Yoshida et al. ..... 174/36

*Primary Examiner*—Kristine L. Kincaid
*Assistant Examiner*—Christopher Horgan
*Attorney, Agent, or Firm*—Haynes and Boone

[57] ABSTRACT

A cable assembly for connection between an audio amplifier and a loudspeaker in which a plurality of insulated electrical signal-conducting wires, or conductors are bundled together. The conductors are formed into two groups, one of which is connected between the positive terminals of the amplifier and the loudspeaker and the other of which is connected between the negative terminals of the amplifier and loudspeaker. The number of conductors and the diameter of each conductor is chosen and the design is such that the characteristic impedance of the cable assembly is within the range of the impedance of the loudspeaker. As a result a significant reduction in ringing and/or blurring of complex musical transient signals caused by reflections attributable to the mismatch between the characteristic impedance of the cable and the input impedance of the loudspeaker is achieved.

13 Claims, 1 Drawing Sheet

AUDIO LOUDSPEAKER CABLE ASSEMBLY

This is a continuation of application(s) Ser. No. 08/057,660 filed on May 4, 1993 now abandoned.

BACKGROUND OF THE INVENTION

This invention relates to a cable assembly and, more particularity, to a cable assembly for connecting an amplifier to a loudspeaker in a sound reproduction system.

Within the chain of components comprising a typical professional or home audio system intended for the high-quality reproduction of music, the loudspeaker has evolved as the weakest link. Unlike other system components, loudspeakers are seldom designed to accurately reproduce complex musical waveforms or their laboratory equivalents such as pulses and square-waves. Nor is concern usually given to the modulus of input impedance versus frequency.

Many popular loudspeaker designs exhibit variations in impedance that range from a minimum of less than one ohm to a maximum exceeding 30 ohms. These variations in loudspeaker impedance are usually accompanied by a large reactive component which may shift from inductive to capacitive with only a small percentage shift in frequency.

Such large excursions in resistance and reactance seriously complicate the process of transferring power from the amplifier to the loudspeaker via a cable while insuring an optimum modulus in radiated sound pressure level (SPL) versus frequency. It appears that most audio cable designers have assumed that, due to the typical short length of loudspeaker cables (relative to the length of a "wavelength" at frequencies within the audio spectrum), the impedance of the cable, especially when compared to the impedance of the loudspeaker, is unimportant. In fact, the majority of presently available loudspeaker cables exhibit characteristic impedances that range from about 50 ohms to over 150 ohms, which is far greater than the impedance of a great majority of loudspeakers which averages about 8 ohms. This induces reflections because of the impedance mismatch between the cable and the loudspeaker (load), which causes ringing and/or audible distortions. This is similar to the "ringing" and blurring of the video image which results from a mismatch between the impedance of the R.F. cable (twin lead or coaxial transmission-line) and the input impedance of the television receiver.

Many prior art cables also suffer from "skin-effect" losses which add signal attenuation at higher audio frequencies which can degrade the perception of "definition" on short-duration musical transients. Other poorly designed cables exhibit the property of time/frequency dispersiveness due to the use of unsuitable dielectric material that causes different frequencies to travel along the cable at different velocities, resulting in the blurring or smearing of musical transients.

SUMMARY OF THE INVENTION

The present invention is a result of the discovery that the use of a cable to connect the power amplifier to the loudspeaker introduces another complicating variable that must be taken into consideration if accurate sound reproduction is important.

Therefore, the genesis of the present invention lies in the recognition that, if a stable amplifier and a loudspeaker with a smooth and largely resistive impedance curve are employed, improved performance will be achieved when the impedance of the cable connecting the amplifier to the loudspeaker is within the range of impedance of the loudspeaker, and optimum performance will occur when the impedance of the cable is approximately equal to the average or mean impedance of the loudspeaker.

It is therefore an object of the present invention to provide a cable assembly for connecting an amplifier to a loudspeaker that provides an improvement in overall accuracy and performance compared to existing loudspeaker cable designs.

It is another object of the present invention to provide a cable assembly of the above type which minimizes reflections, ringing, distortions and high-frequency losses.

It is a further object of the present invention to provide a cable assembly of the above type which has a relatively low impedance that is within the impedance range of the loudspeaker to which it is connected.

It is a further object of the present invention to provide a cable assembly of the above type that has an impedance that is approximately equal to the mean or average impedance of the loudspeaker to which it is connected.

It is a still further object of the present invention to provide a cable assembly of the above type which further employs the use of low-loss conductors consisting of a sufficient number of individually insulated conductors to substantially reduce high-frequency losses due to skin-effect.

It is still a further object of the present invention to provide a cable assembly of the above type in which the above-mentioned insulated conductors are surrounded by a metallic sheath to further reduce the impedance of the cable assembly.

Towards the fulfillment of these and other objects the cable assembly of the present invention consists of a plurality of insulated electrical signal-conducting wires, or conductors. The number of conductors and the diameter of each conductor is chosen to optimize all performance parameters and the design is such that the characteristic impedance of the cable assembly is within the range of the impedance of the loudspeaker to which the cable is connected. As a result, a significant reduction in ringing and/or blurring of complex musical transient signals caused by reflections attributable to the mismatch between the characteristic impedance of the cable and the input impedance of the loudspeaker is achieved.

DESCRIPTION OF THE PREFERRED EMBODIMENT

Figure 1:
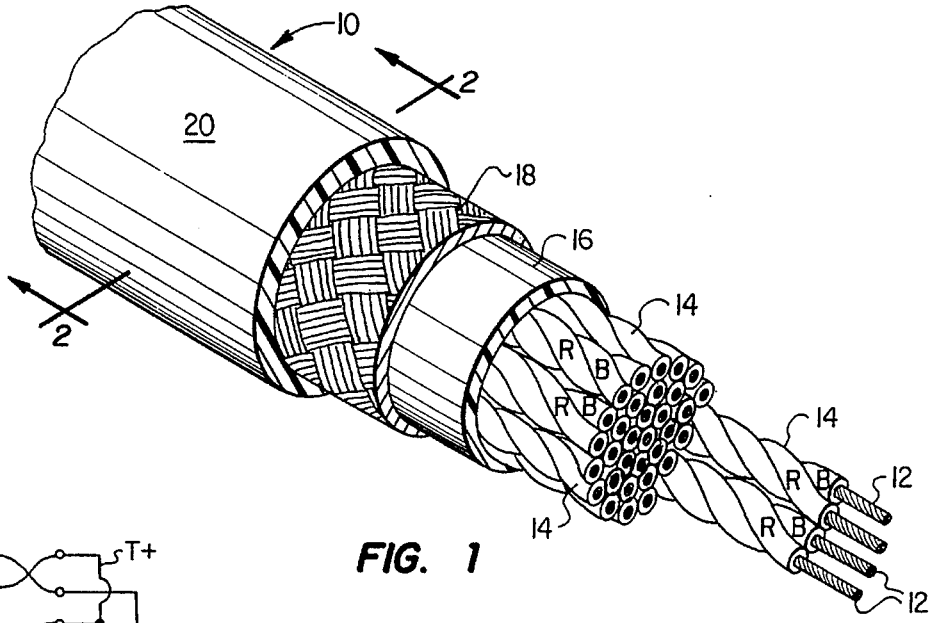
FIG. 1 is a perspective view of the cable assembly of the present invention before final assembly and with one end portion having its outer insulation stripped away.
Figure 2:
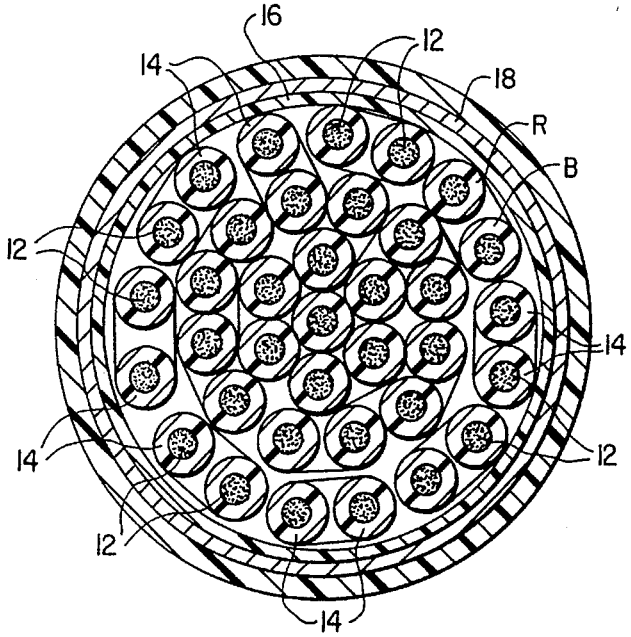
FIG. 2 is an enlarged cross-sectional view taken along the line 2—2 of FIG. 1.

Referring to FIGS. 1 and 2 of the drawings, the reference numeral 10 refers, in general to an exemplary embodiment of the signal cable assembly of the present invention which includes thirty-six individual electrical signal transmitting conductors 12 bundled together in a manner to be described.

Each conductor 12 is formed by a standard stranded, current-conducting metal, preferably of copper, silver, or silver plated copper, of a No. 24 (AWG). A sheath 14 extends over each conductor 12 and each sheath 14 is formed by a high-quality dielectric material such as semi-rigid PVC, polypropylene, polyethylene, teflon, or the like. Each sheath 14 preferably has a 0.010 in. wall thickness, which exhibits uniformly low loss (and constant wave-propagation velocity) over the entire audio spectrum. The conductors 12 are formed into eighteen pairs and, in order to impart flexibility to the cable assembly 10, the two conductors of each pair are twisted with a 1.25 inch ±0.50 left hand lay. Although not clear from the drawing, the twisted pairs, in turn, can be twisted relative to each other with a 5.5 inch ±0.75 left hand lay. The sheaths 14 are "color coded" by two colors such as red and black (shown by "R" and "B" on a few conductors, by means of example, in the drawings), with each pair including one conductor of each color. In FIG. 1, two pairs of twisted conductors 12 are shown extended out from the remaining conductors for the convenience of presentation with their corresponding sheaths 14 being stripped away from their respective end portions.

The conductors 12, along with their respective sheaths 14, are all encased within an insulated sheath 16, preferably of a 0.001 in. thick mylar which functions to increase the potential breakdown voltage of the cable assembly 10. The sheath 16 is surrounded by a low-loss, highly conducting metallic, cylindrical shield 18, preferably of a #36 AWG tinsel copper braid. The shield "floats," i.e., it is not connected in any circuit and functions to reduce the impedance of the cable by confining a greater portion of the electromagnetic field (generated by current flow through the cable assembly 10) within the interior of the cable assembly.

An insulative jacket 20, preferably of PVC, having a 0.038 normal wall thickness surrounds the shield 18 to protect the mechanical and electrical integrity of the cable assembly 10 thus formed.

Figure 3:
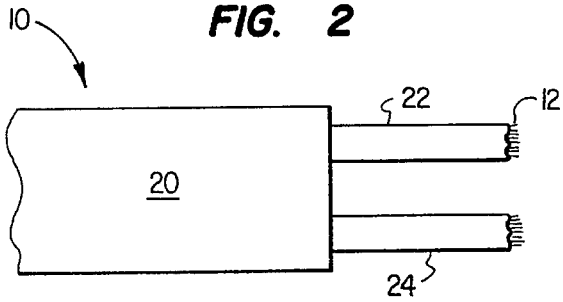
FIG. 3 is a reduced elevational view showing the cable assembly finally assembled.

To prepare the cable assembly 10 for connection between an amplifier and a loudspeaker, the respective end portions of the jacket 20 are stripped away and all of the exposed red color coded conductors 12 at each end of the cable assembly are bundled together and covered by a sheath 22 of dialectric material as shown in connection with one end of the cable assembly 12 in FIG. 3. Similarly, all of the exposed black conductor 12 at each end of the cable assembly 12 are covered by a similar sheath 24. The sheath 22 and 24 can be similar in material and construction to the jacket 20 with the exception that the sheaths 26 and 28 are of a smaller diameter.

Then the sheaths 22 and 14 are stripped away from the respective ends of the bundled red conductors 12 and the conductors are electrically connected by soldering or crimping, as one unit, between the positive terminals of the amplifier and the loudspeaker. In a similar manner the sheaths 24 and 14 are striped away from the respective ends of the bundled black conductors 12 and the conductors are electrically connected by soldering or crimping, as one unit, between the negative terminals of the amplifier and the loudspeaker. In the latter context, standard connectors, such as banana plugs, pin connectors, spade connectors, or the like, can be fastened to the respective exposed ends of the single cable formed by all of the red conductors and the single cable formed by all of the black conductors.

Figure 4:
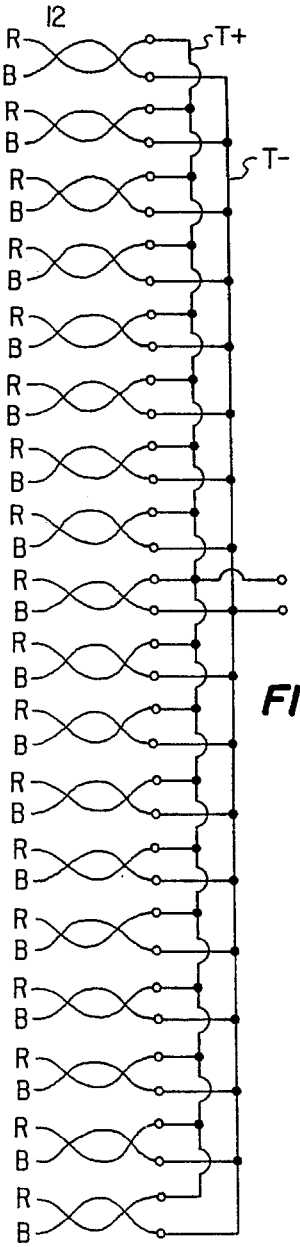
FIG. 4 is a schematic-circuit diagram showing the connection of the cable assembly of FIGS. 1 and 2 to the terminals of an amplifier or loudspeaker.

The equivalent electrical circuit corresponding to the above connections is depicted in FIG. 4 which depicts one end of all of the red conductors R connected to the positive terminal T+ of the amplifier and one end of all of the black conductors B connected to the negative terminal T− of the amplifier. Of course, the other ends of the conductors would be connected to the positive and negative terminals of the loudspeaker in a similar manner.

The sizing and bundling of the conductors 12, the presence of the shield 18, and the connection of the cable assembly 10 in the above manner enable the cable assembly 10 to have a relatively low characteristic impedance according to the following formula:

$$Z=[(R+j\Omega L)]/[G+j\infty C)]^{1/2}$$

where:

Z=the characteristic impedance of the cable R=the resistance per unit length L=the inductance per unit length C=the capacitance per unit length $\Omega = 2\pi f$ (where f=frequency)

If ohmic losses are neglected, the characteristic impedance of a cable becomes simply the square-root of the inductance L (per unit length) divided by the capacitance C (per unit length) or:

$$Z=(L/C)^{1/2}$$

More particularly, the cable assembly 10 described above has a measured inductance of approximately 21,800 pico-Henrys per unit length and a measured capacitance of approximately 340 pico-Farads per unit length. Therefore application of the above latter formula results in a calculated impedance of approximately eight ohms. The cable assembly 10 is therefore suitable for connection to a loudspeaker having an average impedance of eight ohms or at least a range of impedances that includes eight ohms.

It is understood that the cable described above is manufactured by several computer cable manufacturers for a different use (see National Electric Code: Article 725, Type CL2.) More particularly, this type cable is designed to connect a computer to auxiliary equipment, such as a printer, etc., or to another computer and, as such, each of the eighteen pairs of conductors would thus be connected to corresponding pins of a connector so that each pair of conductors carry a separate signal. Therefore, the conductors are not bundled together into two groups respectively carrying the positive and negative portion of the audio signal, per the present invention.

It is understood that the present invention is not limited to the specific cable described above. More particularly, the number of conductors and/or the diameters of the conductors making up the cable assembly can be varied within the scope of the invention, as long as the impedance of the cable of the present invention is within the impedance range of the loudspeaker, and as long as a plurality of insulated conductors are bundled together to form a first group that carries the positive portion of the signal and a second group that carries the negative portion. For example, if a cable assembly of a very large diameter can be tolerated, there can be as few as four conductors divided into two pairs, and one group of two "red" conductors and one group of two "black" conductors. Also, the sheath 16 may be eliminated and the types and sizes of the sheaths 14, the sheath 16, the shield 18 and the jacket 20 may be varied within the scope of the present invention.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A cable assembly comprising a first group of conductors adapted for connection, as a group, between the positive terminal of an amplifier and the positive terminal of a loudspeaker; a second group of conductors adapted for connection, as a group, between the negative terminal of said amplifier and the negative terminal of said loudspeaker; each conductor of said first group being twisted relative to a corresponding conductor of said second group; and a dielectric material extending over at least a portion of each conductor of said first group and said second group.

2. The cable assembly of claim 1 wherein the impedance of said cable assembly is within the impedance range of said loudspeaker.

3. The cable assembly of claim 1 wherein the diameters of said first group of conductors and said second group of conductors are selected so that the impedance of the cable assembly substantially equals the average impedance of said loudspeaker.

4. The cable assembly of claim 1 wherein the number of said first group of conductors and said second group of conductors are selected so that the impedance of the cable assembly substantially equals the average impedance of said loudspeaker.

5. The cable assembly of claim 1 where said dielectric material does not extend over the respective end portions of each of said first group of conductors and said second group of conductors to facilitate said connections.

6. The cable assembly of claim 1 further comprising a metallic sheath extending over said first group of conductors and said second group of conductors and adapted to electrically float.

7. The cable assembly of claim 6 further comprising a sheath of dielectric material extending between said first group of conductors and said second group of conductors and said metallic sheath.

8. A method of connecting an amplifier to a loudspeaker utilizing a multi-conductor cable assembly, said method comprising the steps of connecting the respective ends of a first group of said conductors between the positive terminal of said amplifier and the positive terminal of said loudspeaker, connecting the respective ends of a second group of said conductors between the negative terminal of said amplifier and the negative terminal of said loudspeaker, twisting each conductor of said first group of conductors relative to a corresponding conductor of said second group of conductors, and insulating at least a portion of each of said first group of conductors and said second group of conductors.

9. The method of claim 8 wherein the impedance of said cable assembly is within the impedance range of said loudspeaker.

10. The method of claim 8 wherein the diameters of said first group of conductors and said second group of conductors are selected so that the impedance of the cable assembly substantially equals the average impedance of said loudspeaker.

11. The method of claim 8 wherein the number of said first group of conductors and said second group of conductors are selected so that the impedance of the cable assembly substantially equals the average impedance of said loudspeaker.

12. The method of claim 8 wherein the respective end portions of each of said first group of conductors and said second group of conductors are not insulated, to facilitate said connections.

13. The method of claim 8 further comprising the step of shielding said first group of conductors and said second group of conductors to reduce the impedance of said cable.

* * * * *